US006422009B1

(12) United States Patent
Nozawa et al.

(10) Patent No.: US 6,422,009 B1
(45) Date of Patent: Jul. 23, 2002

(54) PUMP CAPACITY CONTROL DEVICE AND VALVE DEVICE

(75) Inventors: Yusaku Nozawa; Mitsuhisa Tougasaki, both of Ibaraki-ken; Yoshizumi Nishimura; Kinya Takahashi, both of Tsuchiura, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/744,308

(22) PCT Filed: May 26, 2000

(86) PCT No.: PCT/JP00/03386

§ 371 (c)(1),
(2), (4) Date: Jan. 23, 2001

(87) PCT Pub. No.: WO00/73664

PCT Pub. Date: Dec. 7, 2000

(30) Foreign Application Priority Data

May 28, 1999 (JP) ..... 11-149603

(51) Int. Cl.[7] ..... F15B 11/00
(52) U.S. Cl. ..... 60/447; 60/452; 137/87.04
(58) Field of Search ..... 60/447, 452; 137/87.04, 137/115.08

(56) References Cited

U.S. PATENT DOCUMENTS 6,192,681 B1 * 2/2002 Tsuruga et al. ..... 60/447

FOREIGN PATENT DOCUMENTS

| | | |
|---|---|---|
| EP | 877 168 | 11/1998 |
| EP | 879 968 | 11/1998 |
| JP | 2-149881 | 12/1990 |
| JP | 4-19406 | 1/1992 |
| JP | 5-99126 | 4/1993 |

* cited by examiner

*Primary Examiner*—Edward K. Look
*Assistant Examiner*—Thomas E. Lazo
(74) *Attorney, Agent, or Firm*—Mattingly, Stanger & Malur, P.C.

(57) ABSTRACT

A fixed throttle 12 is provided in a delivery line 11*a* of a fixed pump 11 driven by an engine 9 for rotation together with a hydraulic pump 1, and a differential pressure detecting valve 31 is provided in association with the fixed throttle 12 to detect a differential pressure across the fixed throttle 12 and to output a pressure lower than the detected differential pressure by a predetermined value. The output of the differential pressure detecting valve 31 is introduced, as a signal pressure, to a pressure bearing section 5*c* of a load sensing valve 5, thereby setting a target differential pressure. With that arrangement, a pressure in link with an engine revolution speed can be directly employed as the set differential pressure of the load sensing valve, and the structure of the load sensing valve can be avoided from being complicated. Further, in the idling revolution range in which the work amount is relatively small, the displacement of the hydraulic pump can be reduced to improve fine operability and cut down fuel consumption.

8 Claims, 4 Drawing Sheets

PUMP CAPACITY CONTROL DEVICE AND VALVE DEVICE

TECHNICAL FIELD

The present invention relates to a pump displacement control system for a hydraulic drive apparatus provided with a load sensing system for controlling the displacement of a hydraulic pump so that a differential pressure between a delivery pressure of the hydraulic pump and a maximum load pressure among a plurality of actuators is maintained at a set differential pressure. More particularly, the present invention relates to a pump displacement control system for controlling the displacement of a hydraulic pump in link with an engine revolution speed, and a valve unit for use in the pump displacement control system.

BACKGROUND ART

As one hydraulic system for controlling actuators of a hydraulic excavator, there is known the so-called load sensing system including a pump displacement control system wherein respective load pressures of the actuators are detected and the delivery rate of a hydraulic pump is controlled so that the delivery pressure of the hydraulic pump is provided by a pressure equal to the sum of a maximum one of the detected load pressures and a certain set differential pressure. The set differential pressure in such a load sensing system (hereinafter referred to also as the LS set differential pressure) is usually set to a certain constant value (e.g., 15 bar) by biasing means such as a spring.

Also, JP-U-2-149881 and JP-A-5-99126 each disclose a pump displacement control system which enables an actuator speed to be changed in link with an engine revolution speed in the above-described ordinary load sensing system.

In the pump displacement control system disclosed in JP-U-2-149881, a throttle is disposed in a delivery line of a fixed displacement pump that is provided as a hydraulic source of a pilot hydraulic circuit for operating equipment such as a group of hydraulic remote control valves. A pressure upstream of the throttle is detected as a signal pressure Pc, and the detected signal pressure Pc is introduced via a signal hydraulic line to a pressure bearing sector of a load sensing valve on the same side as a pressure bearing sector to which a load pressure Pls is introduced. Since the pressure upstream of the throttle changes depending on the revolution speed of the fixed displacement pump, this means that the detected signal pressure Pc contains information of the revolution speed.

The pump displacement control system disclosed in JP-A5-99126 comprises a servo piston for tilting a swash plate of a variable displacement hydraulic pump, and a tilting control unit for performing displacement control such that, depending on a differential pressure ΔPLS between a delivery pressure Ps of the hydraulic pump and a load pressure PLS of an actuator driven by the hydraulic pump, a pump delivery pressure is supplied to the servo piston so as to maintain the differential pressure ΔPLS at a set value ΔPLSref. The disclosed pump displacement control system further comprises a fixed displacement hydraulic pump driven by an engine together with the variable displacement hydraulic pump, a throttle provided in a delivery line of the fixed displacement hydraulic pump, and means for varying the set value ΔPLSref of the tilting control unit depending on a differential pressure ΔPp across the throttle. The engine revolution speed is detected in accordance with change of the differential pressure across the throttle provided in the delivery line of the fixed displacement hydraulic pump, and the set value ΔPLSref of the tilting control unit is varied depending on the detected engine revolution speed.

DISCLOSURE OF THE INVENTION

In a hydraulic drive apparatus provided with a typical conventional load sensing system wherein the set differential pressure of a load sensing valve is given by a spring, even when the engine revolution speed is lowered, the displacement of a hydraulic pump is not changed and the flow rate of a hydraulic fluid supplied to an actuator is also not changed. Accordingly, the actuator speed cannot be slowed down in link with the engine revolution speed. The working speed can be regulated by adjusting the throttle opening of a flow control valve, but to this end a control lever for adjusting the throttle opening of the flow control valve must be operated while holding a lever position within an intermediate stroke range. To improve fine operability, it is desired that, even with the control lever held at a full stroke position, when the engine revolution speed is lowered, the maximum actuator speed (maximum flow rate of the hydraulic fluid supplied to the actuator) can be reduced correspondingly for adjustment of the maximum working speed.

In the pump displacement control system disclosed in JP-U-2-149881, the set differential pressure of the load sensing valve is given by the signal pressure Pc that is obtained by detecting the pressure upstream of the throttle provided in the delivery line of the fixed pump. As a result, with a decrease of the engine revolution speed, the signal pressure (pressure upstream of the throttle) Pc is lowered, which in turn lowers the set differential pressure of the load sensing valve, whereby the displacement of the hydraulic pump is reduced and the working speed of the actuator is slowed down. It is hence possible to control the displacement of the hydraulic pump and adjust the working speed in link with the engine revolution speed.

In the disclosed pump displacement control system, the pilot hydraulic circuit is provided to produce a signal pressure for operating the equipment such as a group of hydraulic remote control valves, and the pressure downstream of the throttle for detecting the engine revolution speed is set by a relief valve for setting a primary pilot pressure. Letting Pa be the pressure set by the relief valve and Pb be the pressure loss caused by the throttle for detecting the engine revolution speed, the pressure (signal pressure) Pc upstream of the throttle is expressed by Pc=Pa+Pb.

Assuming, for example, that the set pressure Pa of the relief valve for setting the primary pilot pressure is 45 bar, the delivery rate of the fixed pump at the engine revolution speed of 2000 rpm is 35 liter/min (the set pressure Pa is assumed to be kept at 45 bar even upon consumption of the pump delivery rate), and the pressure loss Pb caused by the throttle for detecting the engine revolution speed is 15 bar, the pressure Pc upstream of the throttle is 60 bar. In the typical conventional load sensing system wherein the set differential pressure of the load sensing valve is given by a spring, an equivalent pressure applied by the spring is, e.g., about 15 bar. To provide the set differential pressure at a value equal to 15 bar in the pump displacement control system disclosed in JP-U-2-149881, the pressure bearing sector of the load sensing valve is required to modulate 60 bar of the throttle upstream pressure Pc down about ¼, i.e., to 15 bar. Providing such a function to modulate the pressure results in a more complicated structure of the load sensing valve.

In the pump displacement control system disclosed in JP-A-5-99126, the set value ΔPLSref of the tilting control unit is varied depending on the differential pressure ΔPp across the throttle instead of the pressure Pc upstream of the throttle for detecting the engine revolution speed. The differential pressure ΔPp across the throttle coincides with the pressure loss Pb caused in the throttle, and is 15 bar in the above-mentioned example. This value is equal to the equivalent pressure applied by the spring, i.e., about 15 bar, which is provided in the typical conventional load sensing system. Accordingly, when the differential pressure ΔPp across the throttle is employed instead of the pressure Pc upstream of the throttle, the differential pressure ΔPp across the throttle can be directly introduced to act upon the pressure bearing sector of the load sensing valve and the structure of the load sensing valve can be avoided from being complicated. This prior art, however, has a problem as follows.

When the rated revolution speed of the engine is 2000 rpm as mentioned above and the idling revolution speed of the engine is 1000 rpm, the engine revolution speed varies over the range of 1000–2000 rpm. On the other hand, assuming that the differential pressure across the throttle for detecting the engine revolution speed is 15 bar as mentioned above when the engine revolution speed is 2000 rpm, the differential pressure across the throttle developed when the engine revolution speed is 1000 rpm is 7.5 bar. Hence, the differential pressure across the throttle is changed over the range of 7.5–15 bar while the engine revolution speed varies over the range of 1000–2000 rpm. This means that the set differential pressure is changed over the range of 7.5–15 bar for the variable range of 1000–2000 rpm of the engine revolution speed, and that the set differential pressure cannot be reduced down to a level below 7.5 bar. It has been therefore impossible to reduce the displacement of the hydraulic pump down beyond a certain value in the idling revolution range where the work amount is relatively small, to overcome a limitation in improvement of fine operability, and to cut down fuel consumption.

An object of the present invention is to provide a pump displacement control system which enables a pressure varying in link with an engine revolution speed to be directly employed as the set differential pressure of a load sensing valve, thereby avoiding the structure of the load sensing valve from being complicated, and which can reduce the displacement of a hydraulic pump down in the idling revolution range where the work amount is relatively small, thereby improving fine operability and cutting down fuel consumption, as well as a valve unit for use in the pump displacement control system.

(1) To achieve the above object, the present invention provides a pump displacement control system provided in a hydraulic drive apparatus comprising an engine and a variable displacement hydraulic pump driven by the engine for rotation and supplying a hydraulic fluid to a plurality of actuators through respective flow control valves, the pump displacement control system comprising a load sensing valve for controlling a displacement of the hydraulic pump so that a differential pressure between a delivery pressure of the hydraulic pump and a maximum load pressure among the plurality of actuators is maintained at a target differential pressure, a fixed displacement hydraulic pump driven by the engine for rotation together with the variable displacement hydraulic pump, and a throttle provided in a delivery line of the fixed displacement hydraulic pump, the displacement of the variable displacement hydraulic pump being controlled by detecting change of a revolution speed of the engine and modifying the target differential pressure in accordance with change of a differential pressure across the throttle, wherein the pump displacement control system further comprises differential pressure detecting means for detecting the differential pressure across the throttle and outputting, as a signal pressure, a pressure lower than the detected differential pressure by a predetermined value whereby the target differential pressure of the load sensing valve is set based on the outputted signal pressure.

By thus providing the differential pressure detecting means which outputs, as the signal pressure, the pressure lower than the differential pressure across the throttle by the predetermined value, and setting the target differential pressure of the load sensing valve based on the outputted signal pressure, the above-mentioned problems are solved as follows.

1) Since the pressure (signal pressure) lower than the differential pressure across the throttle by the predetermined value, i.e., the output of the differential pressure detecting means, contains information of the engine revolution speed, the displacement of the hydraulic pump can be controlled in link with the engine revolution speed. Further, since the differential pressure across the throttle rather than the pressure upstream of the same is detected as the signal pressure in link with the engine revolution speed, the signal pressure can be employed on the side of the load sensing valve to set the target differential pressure, and the structure of the load sensing valve can be simplified.

2) By setting an opening area of the throttle such that, at the rated revolution speed of the engine, the pressure lower than the differential pressure across the throttle by the predetermined value, i.e., the output of the differential pressure detecting means, is equal to the differential pressure across a throttle in a conventional system wherein the differential pressure across the throttle is employed as it is, a decrease rate of the differential pressure across the throttle with respect to the engine revolution speed is greater than that in the conventional system. Therefore, the output of the differential pressure detecting means in the idling revolution range becomes smaller than the differential pressure across the throttle in the conventional system. As a result, in the idling revolution range in which the work amount is relatively small, the displacement of the hydraulic pump can be reduced to improve fine operability and cut down fuel consumption.

(2) In above (1), preferably, the differential pressure detecting means is a differential pressure detecting valve including a first pressure bearing section to which a pressure upstream of the throttle is introduced and which acts to connect the output side of the differential pressure detecting valve itself to the upstream side of the throttle, a second pressure bearing section to which a pressure downstream of the throttle is introduced and which acts to connect the output side of the differential pressure detecting valve itself to a reservoir, a third pressure bearing section to which a pressure on the output side of the differential pressure detecting valve itself is introduced and which acts to connect the output side of the differential pressure detecting valve itself to the reservoir, and a spring acting to connect the output side of the differential pressure detecting valve itself to the reservoir and setting the predetermined value.

With those features, the differential pressure detecting means operates to lower the output thereof from the differential pressure across the throttle by the predetermined value that is provided as a set value of the spring, thereby outputting the pressure lower than the differential pressure across the throttle by the predetermined value.

(3) In above (1), preferably, the differential pressure detecting means is constituted as an integral valve unit together with the throttle, the valve unit comprising a pump port connected to a delivery line of the fixed displacement hydraulic pump, a reservoir port connected to the reservoir, a circuit port connected to a pilot hydraulic circuit operating by a hydraulic fluid delivered from the fixed displacement hydraulic pump, and a load sensing port connected to the load sensing valve; a spool formed therein with a throttle passage for communicating the pump port and the circuit port with each other at all times and functioning as the throttle, a first notch for controlling communication between the pump port and the load sensing port, and a second notch for controlling communication between the load sensing port and the reservoir port; and spool biasing means for selectively opening the first notch and the second notch to produce, in the load sensing port, the pressure lower than the differential pressure across the throttle by the predetermined value.

By thus constituting the differential pressure detecting means as the integral valve unit together with the throttle, an integrated unit of the throttle and the pressure detecting means can be realized with a simplified construction.

(4) In above (3), preferably, the throttle passage formed in the spool has a throttle hole being open in the radial direction of the spool.

With that feature, since no fluid forces are caused in the throttle passage, an effect of fluid forces upon the spool stroke can be eliminated and a precise signal pressure in link with the engine revolution speed can be produced.

(5) In above (3), preferably, the spool biasing means comprises a first pressure bearing section to which a pressure in the pump port is introduced and which is formed to bias the spool in the opening direction of the first notch, a second pressure bearing section to which a pressure in the circuit port is introduced and which is formed to bias the spool in the opening direction of the second notch, a third pressure bearing section to which a pressure in the load sensing port is introduced and which is formed to bias the spool in the opening direction of the second notch, and a spring acting upon the spool to bias the spool in the opening direction of the second notch for thereby setting the predetermined value.

With those features, the spool biasing means selectively opens the first notch and the second notch to produce, in the load sensing port, the pressure lower than the differential pressure across the throttle by the predetermined value.

(6) Further, to achieve the above object, the present invention provides a valve unit which is provided in a delivery line of a fixed displacement hydraulic pump driven by an engine for rotation together with a variable displacement hydraulic pump, outputs a signal pressure depending on a revolution speed of the engine, and sets a target differential pressure of a load sensing valve associated with the variable displacement hydraulic pump, wherein the valve unit comprises a pump port connected to a delivery line of the fixed displacement hydraulic pump, a reservoir port connected to the reservoir, a circuit port connected to a pilot hydraulic circuit operating by a hydraulic fluid delivered from the fixed displacement hydraulic pump, and a load sensing port for outputting the signal pressure; a spool formed therein with a throttle passage for communicating the pump port and the circuit port with each other at all times and functioning as the throttle, a first notch for controlling communication between the pump port and the load sensing port, and a second notch for controlling communication between the load sensing port and the reservoir port; and spool biasing means for selectively opening the first notch and the second notch to produce, in the load sensing port, a pressure lower than a differential pressure across the throttle by a predetermined value.

The target differential pressure of the load sensing valve is thus set by producing the pressure lower than the differential pressure across the throttle by the predetermined value, and outputting the produced signal pressure as the signal pressure. By so setting the target differential pressure, as described in the foregoing 1) and 2), the structure of the load sensing valve can be avoided from being complicated, and in the idling revolution range in which the work amount is relatively small, the displacement of the hydraulic pump can be reduced to improve fine operability and cut down fuel consumption.

Furthermore, as described in the foregoing (3), an integrated unit of the throttle and the pressure detecting means can be realized with a simplified construction.

(7) In above (6), preferably, the throttle passage formed in the spool has a throttle hole being open in the radial direction of the spool.

With that feature, similarly to the foregoing (4), an effect of fluid forces otherwise caused in the throttle passage can be eliminated and a precise signal pressure in link with the engine revolution speed can be produced.

(8) In above (6), preferably, the spool biasing means comprises a first pressure bearing section to which a pressure in the pump port is introduced and which is formed to bias the spool in the opening direction of the first notch, a second pressure bearing section to which a pressure in the circuit port is introduced and which is formed to bias the spool in the opening direction of the second notch, a third pressure bearing section to which a pressure in the load sensing port is introduced and which is formed to bias the spool in the opening direction of the second notch, and a spring acting upon the spool to bias the spool in the opening direction of the second notch for thereby setting the predetermined value.

With those features, similarly to the foregoing (5), the spool biasing means selectively opens the first notch and the second notch to produce, in the load sensing port, the pressure lower than the differential pressure across the throttle by the predetermined value.

BEST MODE FOR CARRYING OUT THE INVENTION

An embodiment of the present invention will be described below with reference to the drawings.

Figure 1:
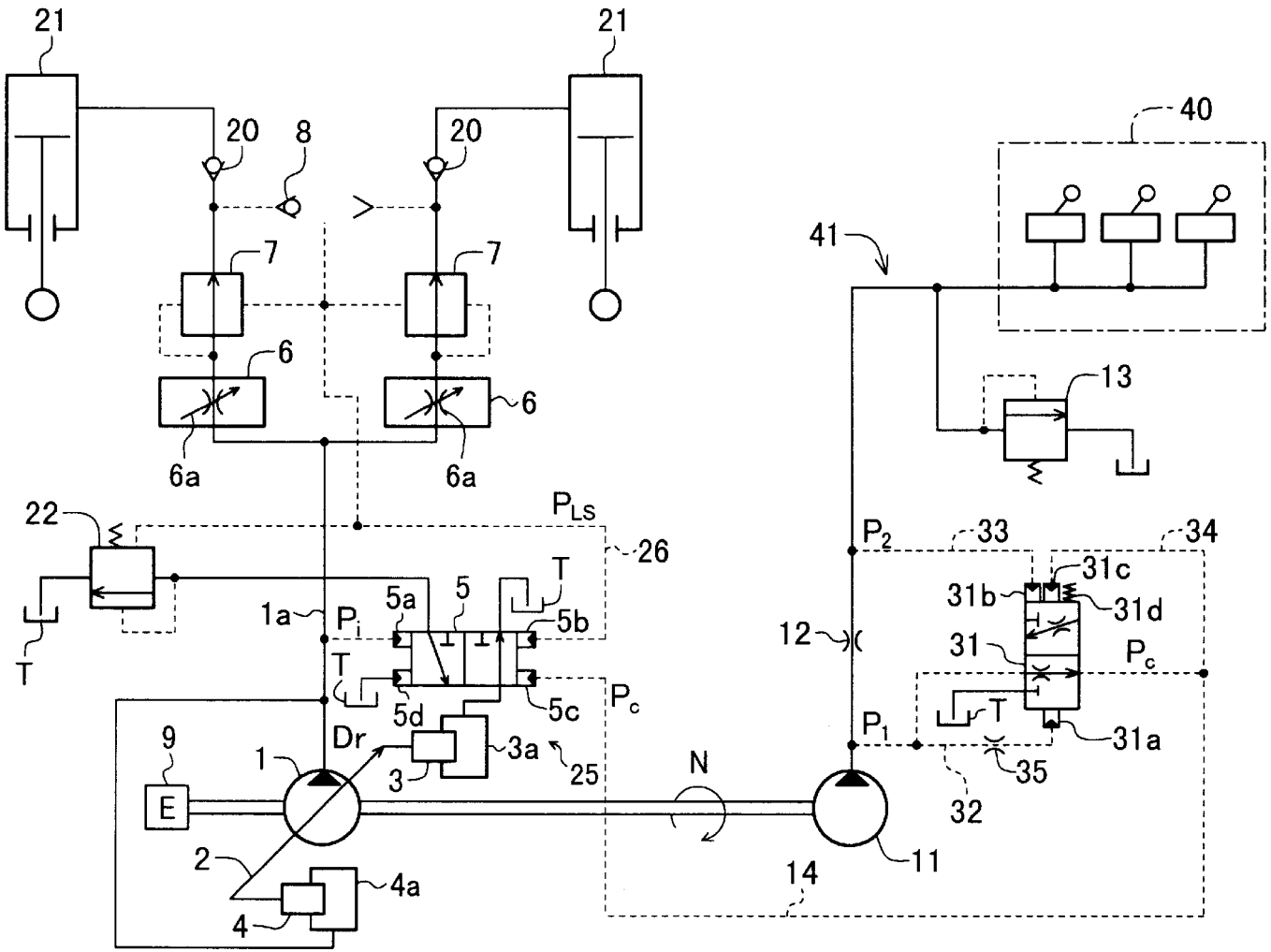
FIG. 1 is a circuit diagram showing a pump displacement control system according to one embodiment of the present invention.

Referring to FIG. 1, numeral 1 denotes a variable displacement hydraulic pump. The hydraulic pump 1 has a displacement adjusting member 2 and is driven by an engine 9. A delivery line 1*a* of the hydraulic pump 1 is connected to directional control valves 6, 6, and a hydraulic fluid delivered from the hydraulic pump 1 is supplied to the directional control valves 6, 6. The directional control valves 6, 6 have respectively flow control throttles 6*a*, 6*a*. Hydraulic fluids having passed the flow control throttles 6*a*, 6*a* pass respectively pressure compensating valves 7, 7 for making control such that differential pressures across the flow control throttles 6*a*, 6*a* are kept equal to each other. Thereafter, the hydraulic fluids flow into actuators 21, 21 through hold check valves 20, 20.

A maximum load pressure Pls is detected through a higher pressure selecting valve 8 from lines between the pressure compensating valves 7, 7 and the hold check valves 20, 20. The detected maximum load pressure Pls is introduced to respective pressure bearing sections of the pressure compensating valves 7, 7 on the valve closing side for controlling the differential pressures across the flow control throttles 6*a*, 6*a* as described above.

An unloading valve 22 is connected to the delivery line 1*a* of the hydraulic pump 1. The maximum load pressure Pls detected by the higher pressure selecting valve 8 is also introduced to the unloading valve 22 to specify a maximum value of a differential pressure between the delivery pressure of the hydraulic pump 1 and the maximum load pressure Pls.

Further, referring to FIG. 1, numeral 25 denotes a pump displacement control system of this embodiment. The pump displacement control system 25 comprises a larger-diameter piston 3 for operating the displacement adjusting member 2 of the hydraulic pump 1 in a direction to reduce the displacement, a smaller-diameter piston 4 for operating the displacement adjusting member 2 in a direction to increase the displacement, and a load sensing valve 5. A pressure bearing chamber 3*a* for the larger-diameter piston 3 is selectively connected to a reservoir T or the delivery line 1*a* of the hydraulic pump 1 under control of the load sensing valve 5, and a pressure bearing chamber 4*a* for the smaller-diameter piston 4 is connected to the delivery line 1*a*.

The load sensing valve 5 has a pressure bearing section 5*a* on the side acting to connect the delivery line 1*a* to the pressure bearing chamber 3*a* for the large-diameter piston 3, and also has pressure bearing sections 5*b*, 5*c* on the side acting to connect the reservoir T to the pressure bearing chamber 3*a*. A pressure Pi (pump delivery pressure) in the delivery line 1*a* is introduced to the pressure bearing section 5*a*, the maximum load pressure Pls detected by the higher pressure selecting valve 8 is introduced to the pressure bearing section 5*b* via a signal line 26, and a signal pressure Pc (described later) is introduced to the pressure bearing section 5*c*. The load sensing valve 5 further includes a drain section 5*d* on the side acting to connect the delivery line 1*a* to the pressure bearing chamber 3*a* for the large-diameter piston 3.

With such an arrangement, the load sensing valve 5 is operated so as to hold a force balance among the pressure Pi in the delivery line 1*a*, the maximum load pressure Pls, and the signal pressure Pc. When the differential pressure (Pi−Pls) is larger than the signal pressure Pc, the load sensing valve 5 is moved to the right as viewed in the drawing, whereupon the hydraulic fluid in the delivery line 1*a* is introduced to the pressure bearing chamber 3*a* to reduce the displacement (tilting angle) of the hydraulic pump 1 until the differential pressure between the pressure Pi in the delivery line 1*a* and the maximum load pressure Pls becomes equal to the signal pressure Pc. In the contrary case, the load sensing valve 5 is in the position as shown and the pressure in the pressure bearing chamber 3*a* is drained to the reservoir T, whereby the displacement (tilting angle) of the hydraulic pump 1 is increased under the action of a force imposed from the smaller-diameter piston 4. With the above-described functions of the load sensing valve 5, the differential pressures across the flow control throttles 6*a*, 6*a* are kept constant. Simultaneously, even when there is a difference between the load pressures of the actuators 21, 21, the differential pressures across the flow control throttles 6*a*, 6*a* are held at the same value for all the actuators with the functions of the pressure compensating valves 7, 7. Accordingly, flow rates of the hydraulic fluids passing the flow control throttles 6*a*, 6*a* are controlled in accordance with an opening area ratio between the flow control throttles 6*a*, 6*a* so that the actuators 21, 21 subjected to the different load pressures can be operated in a combined manner.

The pump displacement control system 25 further comprises a fixed throttle 12 provided in a delivery line 11*a* of a fixed replacement hydraulic pump (hereinafter abbreviated to a fixed pump) 11 that is driven by the engine 9 for ration together with the hydraulic pump 1, a differential pressure detecting valve 31 for detecting a differential pressure across the fixed throttle 12 and outputting a pressure lower than the detected differential pressure by a predetermined value, and a signal hydraulic line 14 for introducing, as a signal pressure, the output of the differential pressure detecting valve 31 to the pressure bearing section 5*c* of the load sensing valve 5.

The fixed pump 11 is inherently provided as a hydraulic source of a pilot hydraulic circuit 41 for operating equipment such as a group 40 of hydraulic remote control valves, and has a displacement to produce a delivery rate of about 35 l/min when the revolution speed of the engine 9 is, e.g., 2000 rpm. A relief valve 13 is disposed in the pilot hydraulic circuit 41, and the pressure downstream of the fixed throttle 12 in the pilot hydraulic circuit 41 is set by the relief valve 13 to a certain pressure of, for example, about 45 bar.

The fixed throttle 12 has an opening area set to produce a differential pressure (resistance) of, for example, about 25 bar, which is larger than 15 bar produced in the conventional system, when the revolution speed of the engine 9 is 2000 rpm and the delivery rate q of the fixed pump 11 is 35 l/min.

The differential pressure detecting valve 31 has a pressure bearing section 31*a* on the side acting to connect the upstream side of the fixed throttle 12 to the output side of the valve 31 itself, and pressure bearing sections 31*b*, 31*c* on the side acting to connect the reservoir T to the output side of the valve 31 itself. A pressure P1 upstream of the fixed throttle 12 is introduced to the pressure bearing section 31*a* via a hydraulic line 32, a pressure P2 downstream of the fixed throttle 12 is introduced to the pressure bearing section 31*b* via a hydraulic line 33, and the output pressure of the valve 31 itself, i.e., the signal pressure Pc, which is obtained by reducing the pressure P1, is introduced to the pressure bearing section 31*c* via a hydraulic line 34. Further, the differential pressure detecting valve 31 includes a spring 31*d* on the side acting to connect the reservoir T to the output side of the valve 31 itself. A throttle 35 for suppressing abrupt change of the hydraulic force acting upon the pressure bearing section 31*a* is provided in the hydraulic line 34.

The differential pressure detecting valve 31 thus constructed is operated so as to hold a force balance among the pressure P1 upstream of the fixed throttle 12, the pressure P2 downstream of the fixed throttle 12, the output pressure Pc of the valve 31 itself, and a value Pk of the biasing force of the spring 31*d* calculated in terms of hydraulic pressure. Based on the relationship of, $$P1=P2+Pc+Pk \quad (1)$$

the balance condition is satisfied when Pc meeting $$Pc=P1-P2-Pk \quad (2)$$

is created on the output side of the differential pressure detecting valve 31. In other words, the differential pressure detecting valve 31 outputs the pressure Pc lower than the differential pressure P1−P2 across the fixed throttle 12 by Pk.

Herein, the spring 31*d* is set to provide the value Pk of, e.g., about 10 bar when the fixed throttle 12 is set, as mentioned above, to produce the differential pressure (resistance) of, e.g., about 25 bar at the engine revolution speed of 2000 rpm.

The operation of the pump displacement control system 25 having the above-described construction will be described below.

A description is first made of the relationship between the output pressure Pc of the differential pressure detecting valve 31 and the displacement of the hydraulic pump 1 (flow rate of the hydraulic fluid passing the flow control throttle 6*a*).

Assuming that the differential pressure P1−P2 across the fixed throttle 12 is Pc', the flow rate of the hydraulic fluid passing the fixed throttle 12 is q, and the delivery rate of the fixed pump 11 per rotation is Dp, the following relationship is held among the flow rate q, the differential pressure Pc', and the engine revolution speed N:

$$q=Dp\cdot N \quad (3)$$

$$q=c\cdot a\sqrt{(2g/r)}\cdot\sqrt{Pc'}=\alpha\cdot\sqrt{Pc'} \quad (4)$$

Hence, the relationship between Pc' and N is given by:

$$Pc'=(Dp\cdot N/\alpha)^2 \quad (5)$$

Conventionally, the differential pressure Pc' across the fixed throttle 12 is directly provided as a setting of the target differential pressure to the load sensing valve 5, and the tilting angle (displacement) of the hydraulic pump 1 is controlled so that the differential pressure across the flow control throttle 6*a* is kept equal to the differential pressure Pc'. In this case, the relationship between the flow rate Q of the hydraulic fluid passing the flow control throttle 6*a* and the differential pressure Pc' is expressed by:

$$Q=c\cdot A\cdot\sqrt{(2g/r)}\cdot\sqrt{Pc'}=\beta\cdot\sqrt{Pc'} \quad (6)$$

Putting the relationship of the above formula (5) in the differential pressure Pc' results in:

$$Q=\beta\cdot(Dp\cdot N/\alpha)=(\beta\cdot Dp/\alpha)\cdot N \quad (7)$$

Thus, the flow rate Q of the hydraulic fluid passing the flow control throttle 6*a* is controlled in proportion to the engine revolution speed N, and the displacement of the hydraulic pump 1 is controlled in proportion to the engine revolution speed N.

In the present invention, since the output pressure Pc of the differential pressure detecting valve 3A is given by Pc=P1−P2−Pk of the above formula (2), the relationship between the flow rate Q of the hydraulic fluid passing the flow control throttle 6*a* and the signal pressure Pc is expressed by:

$$Q=c\cdot A\cdot\sqrt{(2g/r)}\cdot\sqrt{Pc}=\beta\cdot\sqrt{Pc}=\beta\sqrt{(P1-P2-Pk)} \quad (8)$$

Because of Pc'=P1−P2, the formula (8) is rewritten to:

$$Q=\beta\cdot\sqrt{(Pc'-Pk)}$$

Putting the relationship of the above formula (5) in the differential pressure Pc' results in:

$$Q=\beta\cdot\sqrt{((Dp\cdot N/\alpha)^2-Pk)} \quad (9)$$

Also in the present invention, therefore, the flow rate Q of the hydraulic fluid passing the flow control throttle 6*a* is controlled in link with the engine revolution speed N, and the displacement of the hydraulic pump 1 is controlled in link with the engine revolution speed N.

The operation of the differential pressure detecting valve 31 is described below.

Figure 2:
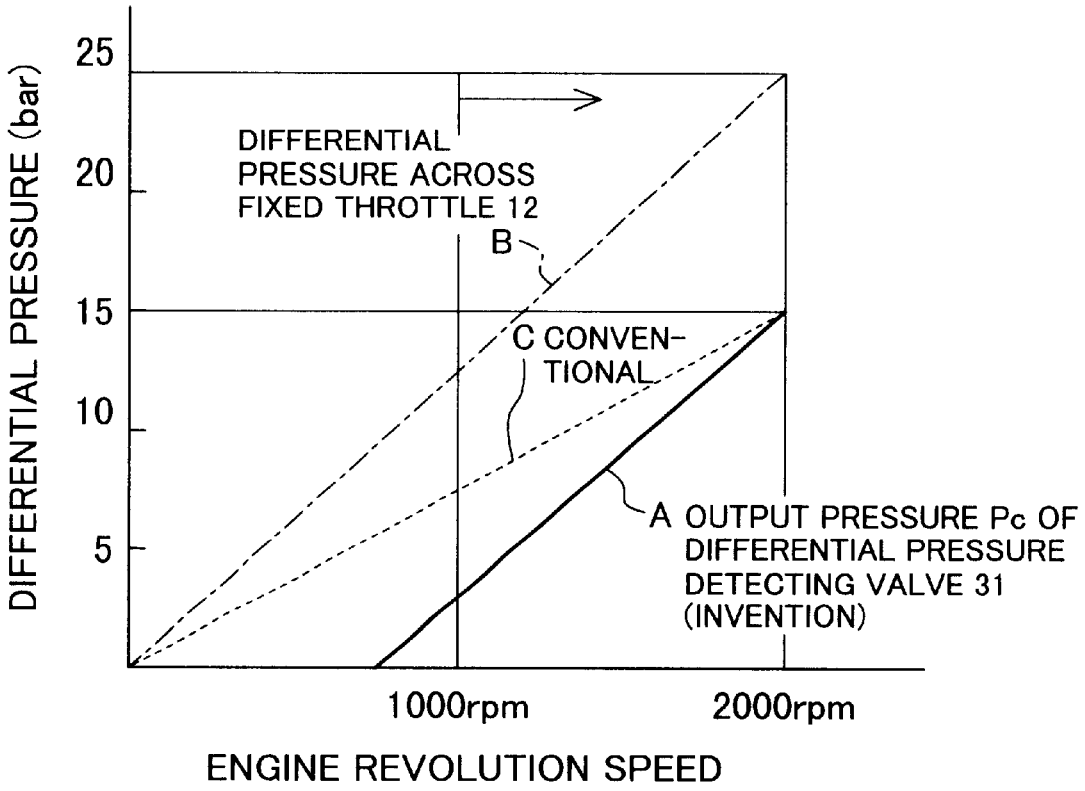
FIG. 2 is a graph showing an output characteristic of a differential pressure detecting valve in the pump displacement control system shown in FIG. 1.

The differential pressure detecting valve 31 includes the spring 31*d* as mentioned above, and outputs the pressure Pc lower than the differential pressure (P1−P2) across the fixed throttle 12 by the set value Pk of the spring 31*d*. FIG. 2 shows an output characteristic of the differential pressure detecting valve 31 in comparison with that of the conventional system. In FIG. 2, a solid line A represents the characteristic of the differential pressure detecting valve 31 of the present invention, a one-dot-chain line B represents a characteristic of the fixed throttle 12, and a broken line C represents a characteristic given by a differential pressure detecting valve and a fixed throttle in the conventional system.

In the conventional system, the opening area of the fixed throttle is set such that the differential pressure (P1−P2) of about 15 bar is produced across the fixed throttle when the engine revolution speed is at a rated value of 2000 rpm and the delivery rate q of the fixed pump 11 is 35 l/min. As the engine revolution speed decreases, the differential pressure across the fixed throttle is lowered as indicated by the broken line C. When the engine revolution speed is in the idling range of, for example, around 1000 rpm, the differential pressure across the fixed throttle is about 7.5 bar, i.e., a half that produced at 2000 rpm.

Moreover, in the conventional system, because the differential pressure (P1−P2) across the fixed throttle is directly employed as the signal pressure Pc, Pc=about 15 bar is resulted when the engine revolution speed is at the rated value of 2000 rpm, and Pc=about 7.5 bar is resulted when the engine revolution speed is around 1000 rpm.

By contrast, in the present invention, the opening area of the fixed throttle 12 is set to produce the differential pressure (P1−P2) of about 25 bar when the engine revolution speed is at the rated value of 2000 rpm and the delivery rate q of the fixed pump 11 is 35 l/min. As the engine revolution speed decreases, the differential pressure across the fixed throttle is lowered as indicated by the one-dot-chain line B. When the engine revolution speed is in the idling range of, for example, around 1000 rpm, the differential pressure across the fixed throttle 12 is about 12.5 bar, i.e., a half that produced at 2000 rpm.

Further, the differential pressure detecting valve 31 includes the spring 31*d* and produces the output pressure Pc given by Pc=P1−P2−Pk of the above formula (2). The output pressure Pc is therefore lower than the differential pressure (P1−P2) across the fixed throttle 12 by the set value Pk of the spring 31*d*. In this embodiment, since Pk is set to about 10 bar as mentioned above, the output pressure Pc of the differential pressure detecting valve 31 has a characteristic, indicated by the solid line A, which is shifted 10 bar downward from the characteristic representing the differential pressure across the fixed throttle 12. In other words, Pc=about 15 bar is resulted when the engine revolution speed is at the rated value of 2000 rpm, but Pc=about 2.5 bar, which is much smaller than 7.5 bar in the conventional system, is resulted when the engine revolution speed is around 1000 rpm.

Since the relationship between the output pressure Pc of the differential pressure detecting valve 31 and the flow rate Q of the hydraulic fluid passing the flow control throttle 6*a* and hence the displacement of the hydraulic pump 1 is as described above, the displacement of the hydraulic pump 1 can be controlled to reduce proportionally as the signal pressure Pc lowers. As a result, fine operability can be improved and fuel consumption can be cut down.

With this embodiment, as described above, the target differential pressure is set by providing the differential pressure detecting valve 31, which outputs a pressure lower than the differential pressure across the fixed throttle 12 by the predetermined value Pk, and introducing the output pressure, as a signal pressure, to the load sensing valve 5. The following advantages are therefore obtained.

1) Since the pressure (signal pressure) Pc lower than the differential pressure across the fixed throttle 12 by the predetermined value Pk, i.e., the output pressure of the differential pressure detecting valve 31, contains information of the engine revolution speed, the displacement of the hydraulic pump 1 can be controlled in link with the engine revolution speed. Further, since the differential pressure across the fixed throttle 12 rather than the pressure upstream of the same is employed as the signal pressure Pc in link with the engine revolution speed, the signal pressure Pc can be employed for the load sensing valve 5 without modulating it, and the structure of the load sensing valve 5 can be simplified.

2) The opening area of the fixed throttle 12 is set such that, at the rated revolution speed of the engine 9, the pressure lower than the differential pressure across the fixed throttle 12 by the predetermined value Pk, i.e., the output pressure of the differential pressure detecting valve 31, is equal to the differential pressure across the throttle in the conventional system wherein the differential pressure across the fixed throttle 12 is employed as it is. Also, a decrease rate of the differential pressure across the fixed throttle 12 with respect to the engine revolution speed (i.e., a gradient of the characteristic indicated by each of the solid line A and the one-dot-chain line B in FIG. 2) is greater than that (i.e., a gradient of the broken line C in FIG. 2) in the conventional system. Therefore, the output pressure Pc of the differential pressure detecting valve 31 in the idling revolution range becomes smaller than the differential pressure across the throttle in the conventional system. As a result, in the idling revolution range in which the work amount is relatively small, the displacement of the hydraulic pump 1 can be reduced to improve fine operability and cut down fuel consumption.

Next, an embodiment of a valve unit, in which the differential pressure detecting valve 31 is integrally built together with the fixed throttle 12, will be described with reference to FIGS. 3, 4A and 4B.

Figure 3:
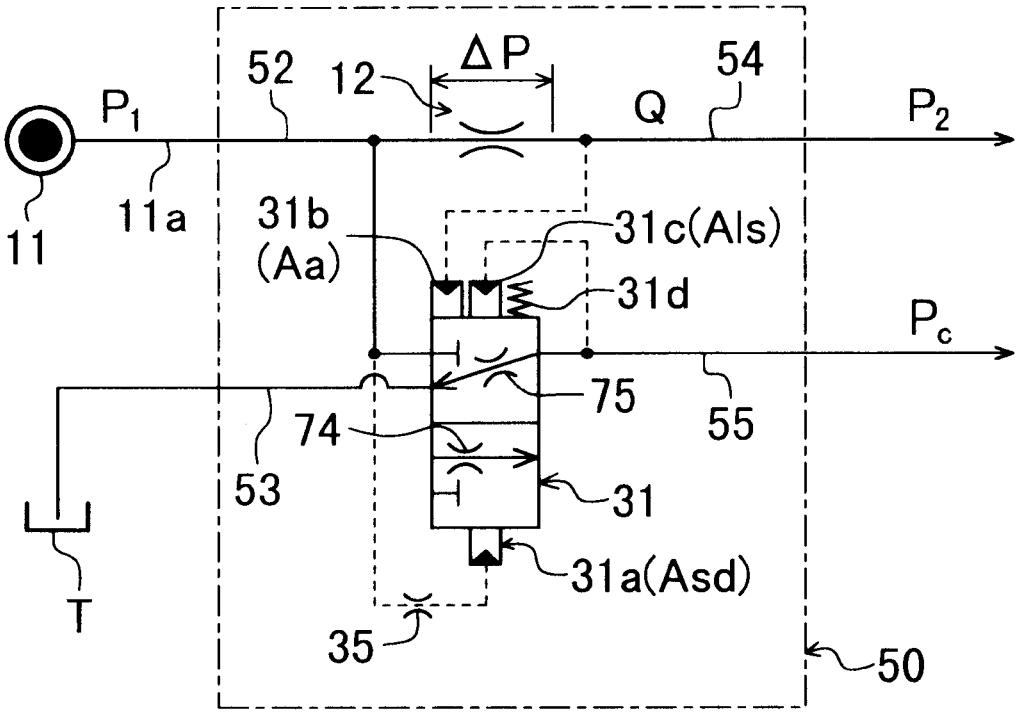
FIG. 3 is a circuit diagram of a valve unit in which a fixed throttle and the differential pressure detecting valve, both shown in FIG. 1, are integrally built.

FIG. 3 is a circuit diagram of a valve unit 50 of this embodiment, showing a condition where the differential pressure detecting valve 31 is in its neutral position with the fixed pump 11 stopped. FIG. 4A shows the structure of the valve unit 50, and FIG. 4B shows the pressure bearing sections 31*a*, 31*b*, 31*c* of the differential pressure detecting valve 31.

Figure 4A:
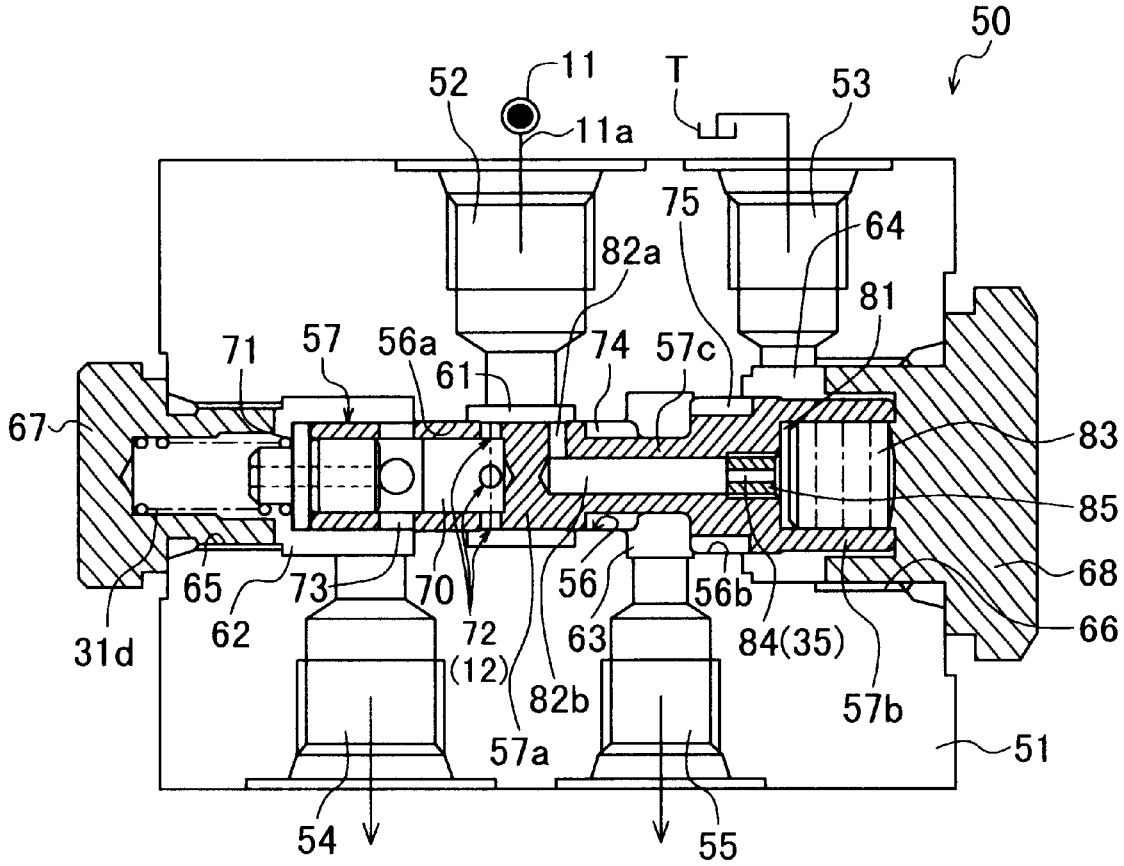
FIG. 4A is a sectional view showing the structure of the valve unit shown in FIG. 3.

Referring to FIG. 4A, the valve unit 50 has a valve block 51 in which there are formed four ports, i.e., a pump port 52 connected to the delivery line 11*a* of the fixed pump 11, a reservoir port 53 connected to the reservoir T, a circuit port 54 connected to the pilot hydraulic circuit 41, and a load sensing port 55 connected to the signal hydraulic line 14. These four ports are formed in the order of ports 54, 52, 55 and 53 from the left side as viewed in the drawing. Further, a spool bore 56 is formed through the valve block 51, and a spool 57 is slidably inserted in the spool bore 56. The spool 57 has a smaller-diameter portion 57*a*, a larger-diameter portion 57*b*, and a shaft portion 57*c* between both the portions 57*a*, 57*b*. Corresponding to the smaller-diameter portion 57*a* and the larger-diameter portion 57*b* of the spool 57, a smaller-diameter portion 56*a* and a larger-diameter portion 56*b* are formed in the spool bore 56. In addition, an internal port 61 communicating with the pump port 52 and an internal port 62 positioned outward of the internal port 61 and communicating with the actuator port 54 are formed in the smaller-diameter portion 56*a* of the spool bore 56. An internal port 63 communicating with the load sensing port 55 and an internal port 64 positioned outward of the internal port 63 and communicating with the reservoir port 53 are formed in the larger-diameter portion 56*b* of the spool bore 56. The internal ports 61, 64 on both the outer sides are constituted by parts of opening portions 65, 66 that are opened to opposite outer surfaces of the valve block 51 and closed respectively by plugs 67, 68.

Within the smaller-diameter portion 57*a* of the spool 57, a hollow portion 70 is formed to axially extend from a position in the vicinity of the internal port 61 and to be open at a spool end on the smaller-diameter side. An opening at an outer end of the hollow portion 70 is closed by a spring guide 71. Also, the smaller-diameter portion 57*a* is formed with radial throttle holes 72 for communicating the internal port 61 with the hollow portion 70 and constituting the above-mentioned fixed throttle 12, and opening holes 73 for communicating the hollow portion 70 with the internal port 62. A first notch 74, which serves as a pressure-raising variable throttle for controlling communication between the pump port 52 and the load sensing port 55, is formed in the shoulder of the smaller-diameter portion 57*a* adjacent to the shaft portion 57*c*. A second notch 75, which serves as a pressure-reducing variable throttle for controlling communication between the load sensing port 55 and the reservoir port 53, is formed in the shoulder of the larger-diameter portion 57*b* adjacent to the shaft portion 57*c*. Further, within the larger-diameter portion 57*b* of the spool 57, a piston chamber 81 is formed to be open at a spool end on the larger-diameter side. The piston chamber 81 is communicated with the internal port 61 through a radial passage 82*a* and an axial passage 82*b*. In addition, a piston 83 is slidably inserted in the piston chamber 81, and the back of the piston 83 is held in abutment with a plug 68. A plug 85 formed with a throttle hole 84, which constitutes the above-mentioned throttle 35, is disposed in the axial passage 82*b*.

Figure 4B:
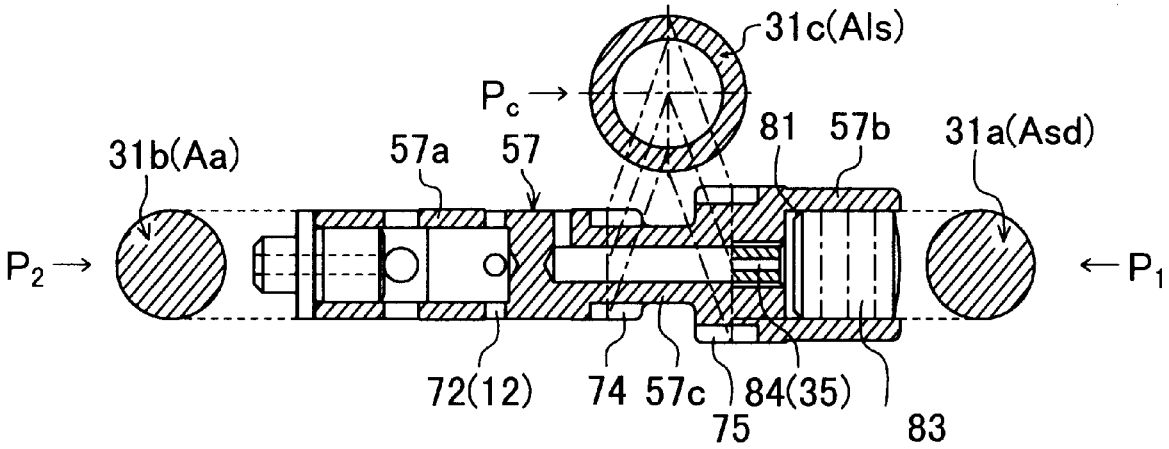
FIG. 4B shows pressure bearing sections of the differential pressure detecting valve.

In the spool 57 thus constructed, the above-mentioned pressure bearing sections 31*a*, 31*b*, 31*c* are formed as shown in FIG. 4B. More specifically, the pressure bearing section 31*a* is formed by an end surface of the piston chamber 81 facing the piston 83, and a pressure in the pump port 52 is introduced to the pressure bearing section 31*a* to bias the spool 57 to the left as viewed in the drawing (in the opening direction of the first notch 74). The pressure bearing section 31*b* is formed by an end of the smaller-diameter portion 57*a* of the spool 57, and a pressure in the circuit port 54 is introduced to the pressure bearing section 31*b* to bias the spool 57 to the right as viewed in the drawing (in the opening direction of the second notch 75). The pressure bearing section 31*c* is formed at an end surface of the larger-diameter portion 57*b* of the spool 57 adjacent to the intermediate shaft portion 57*c* by an area difference between the end surface of the larger-diameter portion 57*b* and an end surface of the smaller-diameter portion 57*a*, and a pressure in the load sensing port 55 is introduced to the pressure bearing section 31*c* to bias the spool 57 to the right as viewed in the drawing (in the opening direction of the second notch 75). The pressure bearing sections 31*a*, 31*b*, 31*c* have pressure bearing areas set to be all equal to each other.

In the opening portion 65 where the internal port 62 is formed, the above-mentioned spring 31*d* is held on the same side as the plug 67 between the plug 67 and spring guide 71 to bias the spool 57 to the right as viewed in the drawing.

The pressure bearing sections 31*a*–31*c* and the spring 31*d* constitute spool biasing means for selectively opening the first notch 74 and the second notch 75 to produce, in the load sensing port 55, the pressure Pc lower than the differential pressure across the throttle holes 72 (fixed throttle 12) by the predetermined value.

In the valve unit 50 having the above-described construction, a balance among forces acting upon the spool 57 is expressed by the following formula:

$$P2 \cdot Aa + Pc \cdot Als + k(x+xs) = P1 \cdot Asd \quad (10)$$

Aa: pressure bearing area of the pressure bearing section 31*b*

Asd: pressure bearing area of the pressure bearing section 31*a*

Als: pressure bearing area of the pressure bearing section 31*c*

(Aa=Asd=Als)

x: deviation of the spring 31*d* xs: set (initial) bias of the spring 31*d* k: spring constant of the spring 31*d*

Putting Aa=Asd=Als=Ao in the formula (10) results in:

$$P2 + Pc + k(x+xs)/Ao = P1 \quad (11)$$

When the fixed pump 11 starts delivery of the hydraulic fluid and the hydraulic fluid is introduced to the valve unit through the pump port 52, the hydraulic fluid flows out from the actuator port 54 through the throttle holes 72 (fixed throttle 12) and also flows into the piston chamber 81 through the throttle hole 84 (throttle 35). When the fixed pump 11 is stopped, the above balance formula (10) can be rearranged as shown below because of x=0 and Pls=0:

$$P2 + Pc + kxs/Ao = P1 \quad (12)$$

When the pump delivery pressure increases with the startup of the fixed pump 11, the pressure P1 increases and the right side of the above formula (12) has a relatively larger value. Because the pressure P2 in the actuator port 54 is held constant, the force balance is thereby lost, whereupon the spool 57 starts to move to the left as viewed in the drawing. Upon the movement of the spool 57 to the left as viewed in the drawing, the first notch 74 is opened to allow the hydraulic fluid to flow into the load sensing port 55, and at the same time the second notch 75 is closed to establish the pressure Pc in the load sensing port 55. When the pressure Pc increases, the left side of the above formula (12) has a relatively larger value, whereby the spool 57 starts to move to the right as viewed in the drawing. Upon the movement of the spool 57 to the right as viewed in the drawing, the first notch 74 is closed to stop the hydraulic fluid from flowing into the load sensing port 55, and at the same time the second notch 75 is opened, causing the hydraulic fluid in the load sensing port 55 to be drained to the reservoir T through the reservoir port 53, whereby the pressure Pc is reduced. When the pressure Pc reduces, the left side of the above formula (12) has a relatively smaller value, whereby the spool 57 starts to move to the left as viewed in the drawing. Upon the movement of the spool 57 to the left as viewed in the drawing, the first notch 74 is opened to allow the hydraulic fluid to flow into the load sensing port 55, and at the same time the second notch 75 is closed to stop the hydraulic fluid in the load sensing port 55 from being drained, thus allowing the pressure Pc to restore.

Through repetition of the above-described behaviors, the pressure Pc is settled to a constant value expressed by the following formula (13) derived from the above formula (12):

$$Pc = P1 - P2 - kxs \quad (13)$$

In the formula (13), "kxs" corresponds to the value Pk of the biasing force of the spring 31*d* calculated in terms of hydraulic pressure. The formula (13) coincides with the above-mentioned formula (2).

With the valve unit of this embodiment, as described above, the target differential pressure is set by producing the pressure Pc lower than the differential pressure P1−P2 across the throttle holes 72 (fixed throttle 12) by the predetermined value Pk, and introducing the pressure Pc to the load sensing valve. As with the foregoing embodiment, therefore, the structure of the load sensing valve 5 can be avoided from being complicated, and the displacement of the hydraulic pump 1 can be reduced in the idling revolution range in which the work amount is relatively small. It is hence possible to improve fine operability and cut down fuel consumption.

Also, since the fixed throttle 12 and the differential pressure detecting valve 31 are integrally built in the valve unit using the common spool 57, an integrated unit of both the fixed throttle 12 and the differential pressure detecting valve 31 can be realized with a simplified construction.

Further, since the fixed throttle 12 is constituted by the radial throttle holes 72, no fluid forces are caused in the throttle holes 72, and the stroke of the spool 57 is unaffected by fluid forces even when the flow rate of the hydraulic fluid passing the throttle holes 72 is changed with change of the engine revolution speed. Accordingly, a precise signal pressure in link with the engine revolution speed can be produced and control accuracy can be improved.

It is to be noted that the output of the differential pressure detecting valve 31 is directly introduced as the signal pressure to the pressure bearing section 5*c* of the load sensing valve 5 in the above-described embodiment, but it may be indirectly introduced thereto. For example, the arrangement may be modified such that the signal pressure is detected by a pressure sensor, a detected signal is inputted to a controller which outputs a signal to a solenoid proportional valve after processing the input signal in an appropriate manner, and an output pressure of the solenoid proportional valve is introduced to the pressure bearing section 5*c* of the load sensing valve 5. The process carried out by the controller is, e.g., a low-pass filtering process (dead zone process) for eliminating an effect of variations in the engine revolution speed caused by load fluctuations. In such a case of introducing the signal pressure through the controller, since the signal pressure has been already appropriately processed by the differential pressure detecting valve 31, the amount of computation required to be executed in the controller is reduced and similar advantages as described above can also be obtained without imposing an extra load upon the controller.

Industrial Applicability

According to the present invention, a pressure in link with the engine revolution speed can be directly employed as the set differential pressure of a load sensing valve, and the structure of the load sensing valve can be simplified. Further, in the idling revolution range in which the work amount is relatively small, the displacement of a hydraulic pump can be reduced to improve fine operability and cut down fuel consumption.

Also, according to the present invention, since differential pressure detecting means is constituted as an integral valve unit together with a throttle, an integrated unit of the throttle and the pressure detecting means can be realized with a simplified construction.

Moreover, since the throttle is formed by small radial holes, an effect of fluid forces upon the stroke of a spool can be eliminated and a precise signal pressure in link with the engine revolution speed can be produced.

What is claimed is:

1. A pump displacement control system (25) provided in a hydraulic drive apparatus comprising an engine (9) and a variable displacement hydraulic pump (1) driven by said engine for rotation and supplying a hydraulic fluid to a plurality of actuators (21, 21) through respective flow control valves (6, 6), said pump displacement control system comprising a load sensing valve (5) for controlling a displacement of said hydraulic pump so that a differential pressure between a delivery pressure of said hydraulic pump and a maximum load pressure among said plurality of actuators is maintained at a target differential pressure, a fixed displacement hydraulic pump (11) driven by said engine for rotation together with said variable displacement hydraulic pump, and a throttle (12) provided in a delivery line of said fixed displacement hydraulic pump, the displacement of said variable displacement hydraulic pump being controlled by detecting change of a revolution speed of said engine and modifying said target differential pressure in accordance with change of a differential pressure across said throttle, wherein:

said pump displacement control system further comprises differential pressure detecting means (31; 50) for detecting the differential pressure across said throttle (12) and outputting, as a signal pressure, a pressure lower than the detected differential pressure by a predetermined value whereby the target differential pressure of said load sensing valve (5) is set based on the outputted signal pressure.

2. A pump displacement control system according to claim 1, wherein said differential pressure detecting means is a differential pressure detecting valve (31) including a first pressure bearing section **(31*a*) to which a pressure upstream of said throttle (12) is introduced and which acts to connect the output side of said differential pressure detecting valve (31) itself to the upstream side of said throttle, a second pressure bearing section (31*b*) to which a pressure downstream of said throttle (12) is introduced and which acts to connect the output side of said differential pressure detecting valve (31) itself to a reservoir, a third pressure bearing section (31*c*) to which a pressure on the output side of said differential pressure detecting valve (31) itself is introduced and which acts to connect the output side of said differential pressure detecting valve (31) itself to said reservoir, and a spring (31*d*) acting to connect the output side of said differential pressure detecting valve (31)** itself to said reservoir and setting said predetermined value.

3. A pump displacement control system according to claim 1, wherein said differential pressure detecting means is constituted as an integral valve unit (50) together with said throttle (12), said valve unit comprising:

a pump port (52) connected to a delivery line **(11*a*) of said fixed displacement hydraulic pump (11), a reservoir port (53) connected to said reservoir, a circuit port (54) connected to a pilot hydraulic circuit (41) operating by a hydraulic fluid delivered from said fixed displacement hydraulic pump, and a load sensing port (55) connected to said load sensing valve (5), a spool (57) formed therein with a throttle passage (72) for communicating said pump port (52) and said circuit port (54) with each other at all times and functioning as said throttle (12), a first notch (74) for controlling communication between said pump port (52) and said load sensing port (55), and a second notch (75) for controlling communication between said load sensing port (55) and said reservoir port (53), and spool biasing means (31*a*, 31*b*, 31*c*, 31*d*) for selectively opening said first notch and said second notch to produce, in said load sensing port (55), the pressure lower than the differential pressure across said throttle (12)** by the predetermined value.

4. A pump displacement control system according to claim 3, wherein said throttle passage formed in said spool (57) has a throttle hole (72) being open in the radial direction of said spool.

5. A pump displacement control system according to claim 3, wherein said spool biasing means comprises a first pressure bearing section **(31*a*) to which a pressure in said pump port (52) is introduced and which is formed to bias said spool (57) in the opening direction of said first notch (74), a second pressure bearing section (31*b*) to which a pressure in said circuit port (54) is introduced and which is formed to bias said spool in the opening direction of said second notch (75), a third pressure bearing section (31*c*) to which a pressure in said load sensing port (55) is introduced and which is formed to bias said spool in the opening direction of said second notch, and a spring (31*d*)** acting upon said spool to bias said spool in the opening direction of said second notch for thereby setting said predetermined value.

6. A valve unit (50) which is provided in a delivery line of a fixed displacement hydraulic pump (11) driven by an engine (9) for rotation together with a variable displacement hydraulic pump (1), outputs a signal pressure depending on a revolution speed of said engine, and sets a target differential pressure of a load sensing valve (5) associated with said variable displacement hydraulic pump, wherein said valve unit comprises:

a pump port (52) connected to a delivery line **(11*a*) of said fixed displacement hydraulic pump (11), a reservoir port (53) connected to said reservoir, a circuit port (54) connected to a pilot hydraulic circuit (41) operating by a hydraulic fluid delivered from said fixed displacement hydraulic pump, and a load sensing port (55) for outputting said signal pressure, a spool (57) formed therein with a throttle passage (72) for communicating said pump port (52) and said circuit port (54) with each other at all times and functioning as said throttle (12), a first notch (74) for controlling communication between said pump port (52) and said load sensing port (55), and a second notch (75) for controlling communication between said load sensing port (55) and said reservoir port (53), and spool biasing means (31***a*, 31*b*, 31*c*, 31*d*) for selectively opening said first notch and said second notch to produce, in said load sensing port (55), a pressure lower than a differential pressure across said throttle (12) by a predetermined value.

7. A valve unit according to claim 6, wherein said throttle passage formed in said spool (57) has a throttle hole (72) being open in the radial direction of said spool.

8. A unit according to claim 6, wherein said spool biasing means comprises a first pressure bearing section (31*a*) to which a pressure in said pump port (52) is introduced and which is formed to bias said spool (57) in the opening direction of said first notch (74), a second pressure bearing section (31*b*) to which a pressure in said circuit port (54) is introduced and which is formed to bias said spool in the opening direction of said second notch (75), a third pressure bearing section (31*c*) to which a pressure in said load sensing port (55) is introduced and which is formed to bias said spool in the opening direction of said second notch, and a spring (31*d*) acting upon said spool to bias said spool in the opening direction of said second notch for thereby setting said predetermined value.

* * * * *